US005435018A

United States Patent [19]

Nishimoto

[11] Patent Number: 5,435,018

[45] Date of Patent: Jul. 25, 1995

[54] ODOR GUIDE APPARATUS FOR TOILET

[75] Inventor: Kiyoshi Nishimoto, Osaka, Japan

[73] Assignee: Luckysun Corporation, Osaka, Japan

[21] Appl. No.: 210,329

[22] Filed: Mar. 18, 1994

[51] Int. Cl.[6] ..... E03D 13/00; E03D 9/052

[52] U.S. Cl. ..... 4/306; 4/213; 40/642; 55/493

[58] Field of Search ..... 4/301, 306, 209, 213; 40/492, 611, 642; 55/491, 493, 521

[56] References Cited

U.S. PATENT DOCUMENTS

| | | | |
|---|---|---|---|
| 704,471 | 7/1902 | Brown | 4/306 X |
| 759,078 | 5/1904 | Craig | 4/306 |
| 2,019,213 | 10/1935 | Dahlman | 55/493 X |
| 2,074,294 | 3/1937 | Woodruff | 55/493 |
| 3,172,747 | 3/1965 | Nodolf | 55/491 X |
| 3,513,643 | 5/1970 | Tarala | 55/521 X |
| 4,829,691 | 5/1989 | Manjos et al. | 40/642 X |

FOREIGN PATENT DOCUMENTS

| | | | |
|---|---|---|---|
| 4272338 | 9/1992 | Japan | 4/306 |
| 0102215 | 11/1923 | Switzerland | 4/306 |

*Primary Examiner*—Robert M. Fetsuga
*Attorney, Agent, or Firm*—Gifford, Krass, Groh, Sprinkle, Patmore, Anderson & Citkowski

[57] ABSTRACT

An odor guide apparatus for a toilet. The apparatus includes an odor guide unit for guiding odor rising from a toilet bowl to flow in a direction away from a user of the toilet bowl, an attachment unit for fixing the odor guide unit to an attaching portion including the toilet bowl and a wall face, and an advertisement display unit formed at a portion of or an entire surface of the odor guide unit facing the user.

13 Claims, 11 Drawing Sheets

ODOR GUIDE APPARATUS FOR TOILET

BACKGROUND OF THE INVENTION

1. Field of the Invention

The present invention relates to an odor guide apparatus for a toilet, and more particularly to the art of deodorization for a urinal or toilet bowl installed in a public site such as a public toilet or a toilet on a train.

2. Description of the Related Art

Conventionally, a ventilation fan is attached to a ceiling or wall face of a room in which a urinal and/or a toilet bowl is installed, thereby to exhaust to the outside the odorous air containing ammonium odor molecules generated in association with use of the toilet.

By the air ventilation, the above method can maintain comfort inside the room. However, the use still tends to suffer from temporary unpleasantness since the odorous air diffused from the toilet bowl and rising to the fan travels in the vicinity of the user's head.

The present invention attends to this inconvenience. A primary object of this invention is to limit the unpleasant feel due to the rising diffused odorous air and also to provide a construction therefor with possibility of effective advertisement as well.

SUMMARY OF THE INVENTION

For accomplishing the above-identified object, an odor guide apparatus for a toilet, according to the present invention, comprises:

an odor guide unit for guiding odor rising from a toilet bowl to flow in a direction away from a user of the toilet bowl;

an attachment unit for fixing the odor guide unit to an attaching portion including the toilet bowl and a wall face; and an advertisement display unit formed at a portion of or an entire surface of the odor guide unit facing the user.

With the above-described construction, the odor rising from the toilet bowl may be guided to flow in a direction away from the user. Further, since the user will remain substantially stationary during his/her use of the toilet bowl to keep facing the odor guide unit, the user naturally keeps facing, i.e. seeing the advertisement display of the guide unit.

As a result, the construction can prevent the user from suffering from the temporary unpleasantness of odor during the use, because the odor may be guided to flow in a direction away from this user. Moreover, the construction also provides the effective advertisement by utilizing the surface of the odor guide unit.

According to one aspect of the invention, the odor guide unit is rendered angle adjustable with respect to the attaching portion.

With this feature, when the attachment condition of the attaching portion varies, through an attachment angle adjustment of the odor guide unit relative to this attaching portion, the odor guide unit may be disposed at an angle where the user may most readily see the advertisement display unit of the odor guide unit.

According to a further aspect of the invention, a deodorizing sheet is detachably attached to an odor flow guide portion of the odor guide unit, the deodorizing sheet being capable of changing odorous molecules in the odor into non-odorous molecules through adsorption or chemical reaction of the odorous molecules.

With the above feature, when the odor rising from the toilet bowl is caused to flow along the odor flow guide portion of the odor guide unit, at least some of the odorous molecules in the odor may be rendered into non-odorous molecules through the adsorption or chemical reaction process in the course of their passage through the deodorizing sheet provided to the odor flow guide portion.

Therefore, the construction of this feature can further reduce the unpleasantness for the user. Moreover, since the deodorizing member is constructed in the form of a sheet, it is possible to minimize the thickness of the odor guide unit, while maximizing the contact surface area for the odorous molecules.

Further and other objects, features and effects of the invention will become apparent from the following more detailed description of the embodiments of the invention with reference to the accompanying drawings.

DESCRIPTION OF THE PREFERRED EMBODIMENTS

Preferred embodiments of an odor guide apparatus for a toilet, relating to the present invention, will now be described in details with reference to the accompanying drawings.

Figure 1:
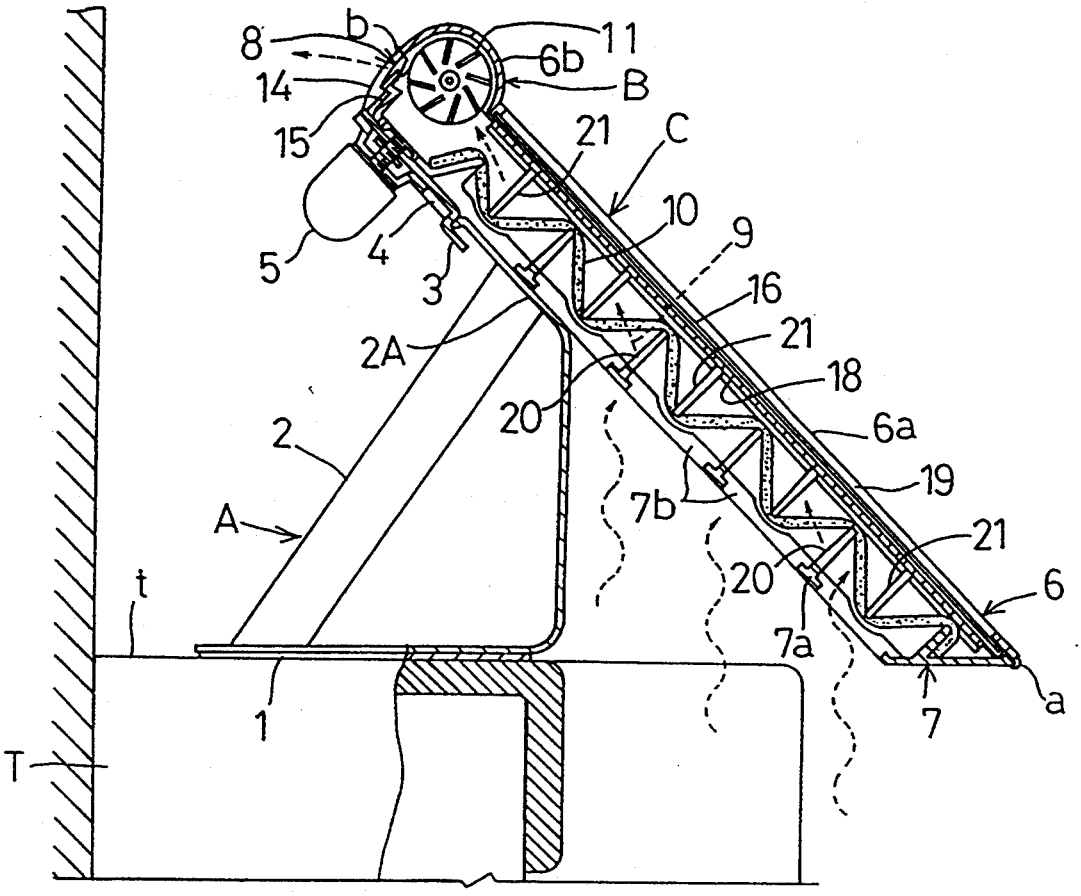
FIG. 1 is a side view in section showing an odor guide apparatus for a toilet, according to one preferred embodiment of the present invention.
Figure 2:
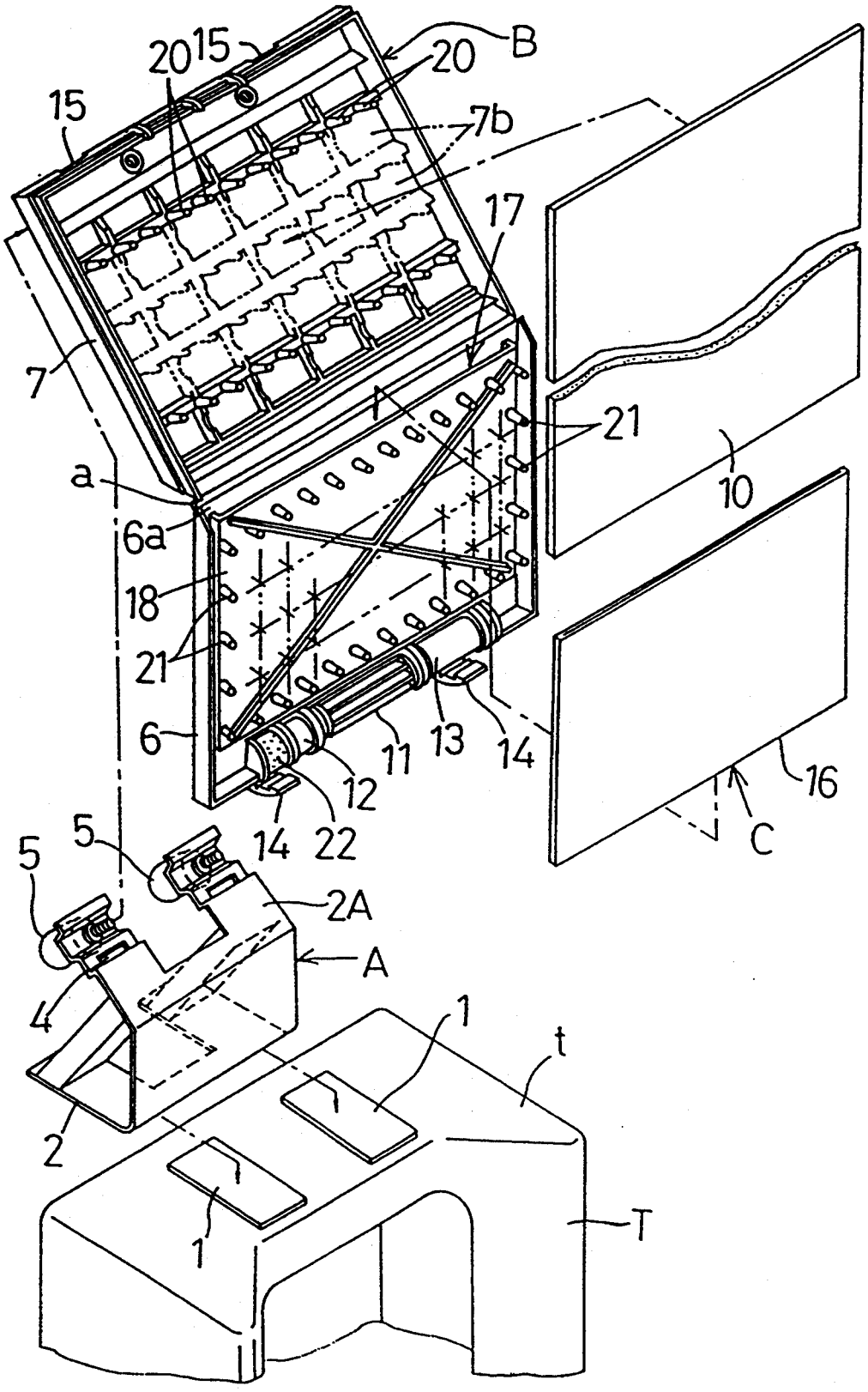
FIG. 2 is an exploded perspective view of the apparatus of FIG. 1.
Figure 3:
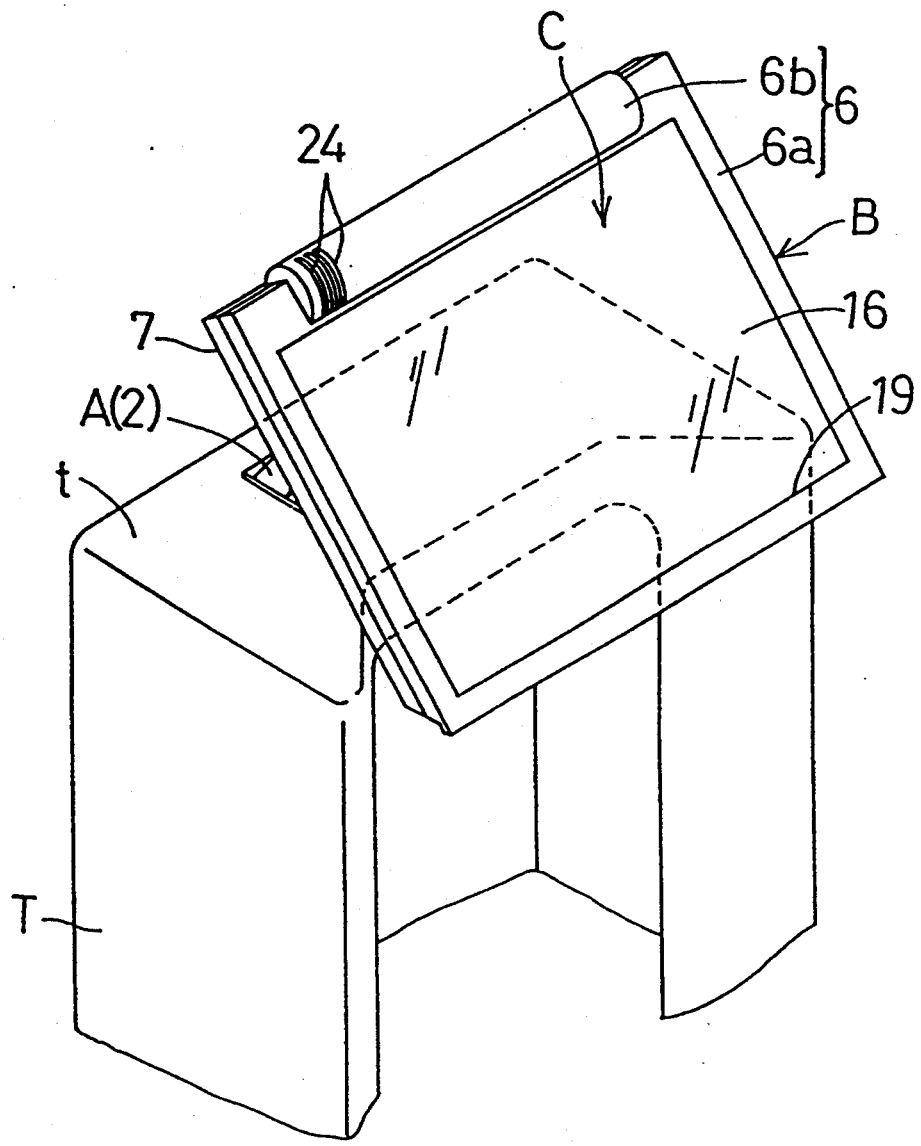
FIG. 3 is a perspective view showing an attachment condition of the apparatus of FIG. 1.

An odor guide apparatus, shown in FIGS. 1 through 3, for use with a toilet includes an attachment unit A fixable to an upper face of a urinal T, and a slanted odor guide unit B for guiding odorous air (containing ammonia odor molecules and so on) rising from the urinal T to flow in a direction away from a user of the urinal. Further, at least most of a front face of the odor guide unit B facing the user is constructed as an advertisement display unit C.

The attachment unit A includes a bent support plate portion 2A for receiving the odor guide unit B to an upper portion of a stand 2 which is to be affixed to an upper portion (t) of the urinal T by means of e.g. a double-sided adhesive tape, with an upper portion of the odor guide unit B oriented away from the user. The support plate portion 2A includes a stopper hole 4 for detachably engaging with an 'L'-shaped stopper element 3 of the odor guide unit B, and a screw element 5 for fastening the odor guide unit B to the stand 2, with the 'L'-shaped stopper element 3 of the odor guide unit B being held at the stopper hole 4.

Inside a pair of case members 6, 7 assembled to each other to form a box-like assembly, the odor guide unit B forms a flow passage 9 for guiding odorous air introduced from the back face of the apparatus to an exhaust opening 8 defined at an upper portion of the case members. Inside the case members 6, 7, the odor guide unit B further includes a deodorizing sheet 10 having air-permeability and capable of changing the odorous molecules of the odorous air into non-odorous molecules through an adsorption-elimination or chemical reaction process, a fan 11 for forcibly exhausting the non-odorous or nearly non-odorous air from the deodorizing sheet 10 through the exhaust opening 8 to the outside, an electric motor 12 acting as a driving means for driving the fan 11, and a battery 13 as a power source of the electric motor 12.

Lower (relative to the slant direction) end portions of two case members 6, 7 are connected to each other via a thin hinge portion (a), to be pivotable to open/close about the same. Further, at an upper end of the front case member 6, there is integrally formed a stopper pawl 14 pivotable about the hinge portion (b). Also, at an upper end of the rear case member 7, there is defined a recess 15 engageable with the stopper pawl 14 of the front case member 6.

Referring to the advertisement display unit C, at the inner side of the front case member 6, there is provided a partition plate 18 for forming a panel accommodating space 17 for holding two sheets of advertisement panels 16, with the panels 16 being freely insertible into and withdrawable from the space. Further, a front plate 6*a* of the front case member 6 includes an advertisement window 19 for allowing a view of the advertisement panels 16 accommodated within the panel accommodating space 17 from the position of the user.

For replacement of the advertisement panels 16, as illustrated in FIG. 2, the front case member 6 is opened toward the forward side relative to the rear case member 7, and the advertisement panels 16 are withdrawn from and inserted into the panel accommodating space 17 in the vertical direction.

Further, since the panel accommodating space 17 can accommodate two sheets of the advertisement panels 16, these panels 16 may also be changed in position relative to each other, depending on the necessity.

A rear plate 7*a* of the rear case member 7 is constructed as a grating-like structure forming a plurality of air intake openings 7*b* in the vertical and lateral directions. Opposing faces of this grating-like rear plate 7*a* and the partition plate 18 of the front case member 6 integrally form groups of projections 20, 21 offset in positions relative to each other, the projections being operable to detachably hold the deodorizing sheet 10 with the sheet 10 being bent in a wave-like pattern.

For attaching the deodorizing sheet 10, as shown in FIG. 2, the front case member 6 is pivotably opened to the forward side relative to the rear case member 7. Then, after placing the deodorizing sheet 10 on the projections 20 of the rear case member 7, the front case member 6 is pivotably closed. With this, the projections 21 of the front case member 6 enter spaces between the respective adjacent pairs of the projections 20 of the rear case member 7, so that the deodorizing sheet 10 is rendered into the wave-like pattern and held under this condition. As a result, in comparison with an arrangement where the deodorizing sheet 10 is flatly disposed along the air intake openings 7*b*, the above-described arrangement can advantageously increase the surface area of the deodorizing sheet 10 which may come into contact with the odor, so that the deodorizing sheet 10 may provide the deodorizing effect for an extended period of time.

The fan 11, the electric motor 12 and the battery 13 are disposed inside a semi-cylindrical portion 6*b* projecting from the upper portion of the front case member 6 to be juxtaposed along a rotational axis of the fan.

Further, at one end inside the semi-cylindrical portion 6*b*, there is formed a housing for an aromatic 22, and the area of the semi-cylindrical portion 6*b* corresponding in position to the aromatic housing defines a plurality of slits 24.

The deodorizing sheet 10 comprises a non-woven cloth or paper impregnated with a deodorant. And, this deodorant may comprise any of carboxylic acid capable of changing odorous molecules of e.g. alkaline odorous molecules into non-odorous molecules, an odor-eliminating agent containing copper salt and zinc salt as major components thereof, a bioactive substance having the structure of ethylene or amino acid and a molecular weight ranging between 15,000 and 230,000 (e.g. "BIODASH" manufactured by Daiso Co., Ltd.), and palm shell activated carbon capable for adsorbing odorous molecules.

A perfume as the major component of the aromatic may comprise any one of natural perfumes (e.g. cedar wood oil, citronella oil, rosemary oil, and so on), synthetic perfumes (e.g. linalool, and so on), or may comprise a mixed perfume mixing a plurality of perfumes together. Thus, the type of perfume may be conveniently selected, depending on the used condition.

Incidentally, in this embodiment, the deodorizing sheet and the aromatic are used together. Thus, the specific components of the deodorizer or the aromatic are selected so that the aromatic molecules should not be changed into non-smelling molecules by the deodorizer.

In this embodiment, the battery 13 is employed as the power source for the electric motor 12 for driving the fan 11. Thus, preferably, the odor guide unit B is provided with a photoelectric sensor for detecting presence of a user. So that, the electric motor 12 is driven only when this photoelectric sensor detects presence of a user.

Further, as the power source for the electric motor 12, an external power source may be employed. Also, a solar battery may be employed as an auxiliary power source.

In the above embodiment, the fan 11 is used as the means for introducing the odorous air into the flow passage 9. The construction is not limited thereto, however. For instance, the odorous air may be introduced into the flow passage 9 by means of e.g. an air current generated in association with a temperature difference generated by a heater.

Further embodiments of the invention will be specifically described next.

Figure 4:
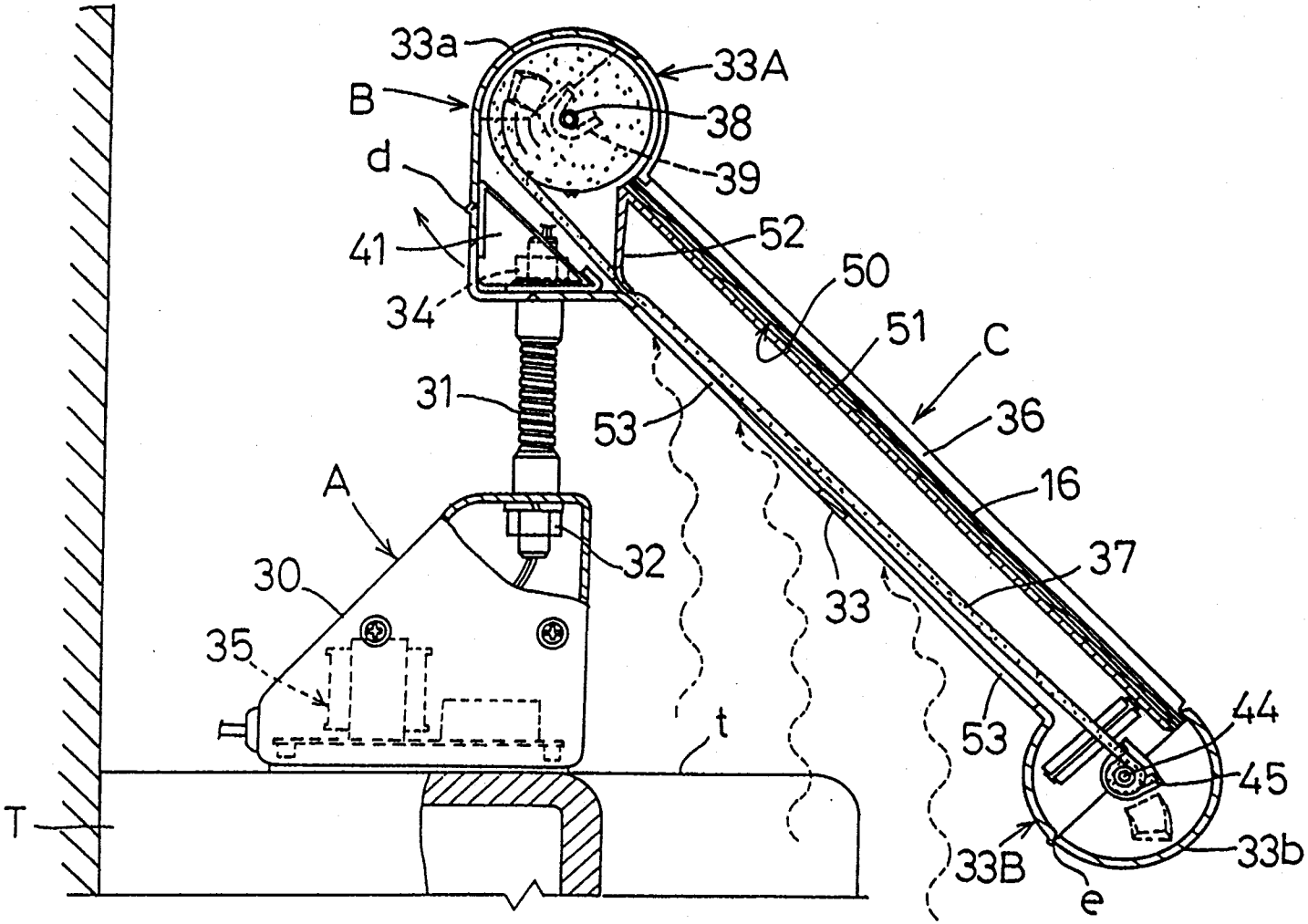
FIG. 4 is a side view in section showing an odor guide apparatus for a toilet, according to a further embodiment of the present invention.
Figure 5:
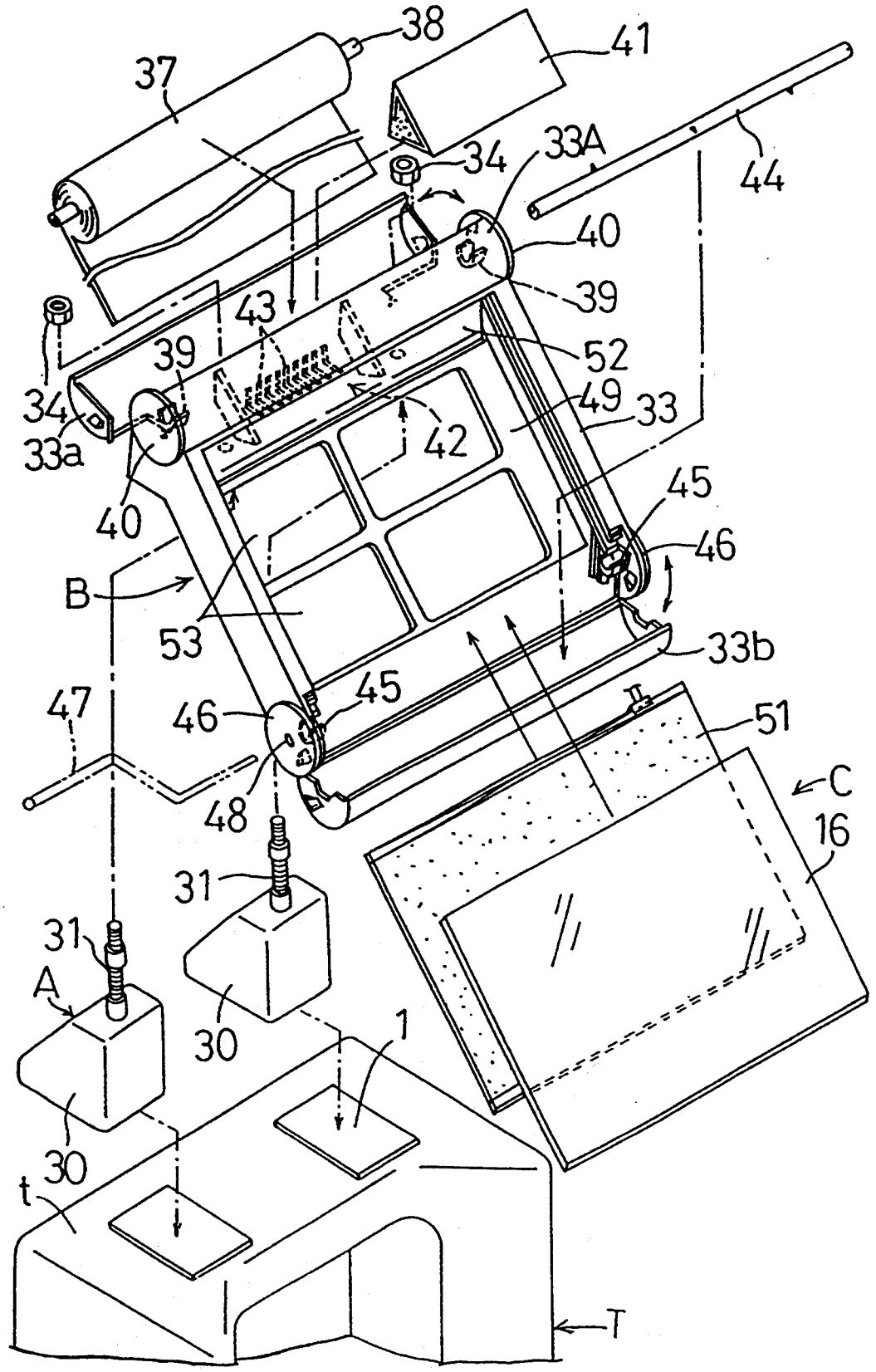
FIG. 5 is an exploded perspective view of the apparatus of FIG. 4.
Figure 6:
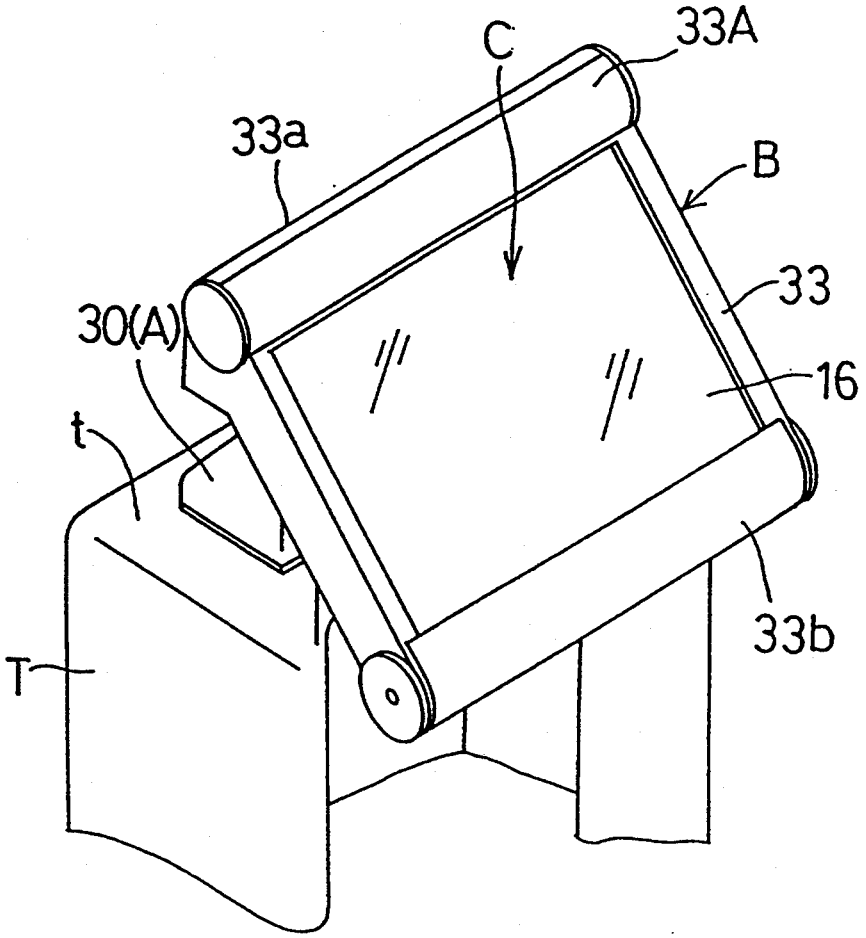
FIG. 6 is a perspective view showing an attachment condition of the apparatus of FIG. 4.

(1) An odor guide apparatus for a toilet, as shown in FIGS. 4 through 6, includes an attachment unit A fixedly attachable to an upper face (t) of the urinal T, and a slanted odor guide unit B for guiding the odor (containing ammonium odorous molecules or the like) rising from the urinal T to flow in a direction away from the user. Further, most of the front side of the surface of the odor guide unit B is constructed as an advertisement display unit C.

The attachment unit A includes a pair of stand boxes which are secured respectively to the upper face (t) of the urinal T by means of e.g. a double-sided adhesive tape. To each of upper portions of these stand boxes 30, a flexible support pipe 31 is fastened by means of a nut 32.

To upper ends of the two support pipes 31, a case 33 for the odor guide unit B is fastened by means of nuts 34. Under this condition, by flexing the support pipes 31, the attachment angle of the odor guide unit B with respect to the attachment unit A may be freely adjusted.

One stand box 30 houses therein an electric circuit 35 for converting 100 V alternating current to 6 V direct current. The other stand box 30 houses therein an unillustrated driving circuit for a face illuminating element 51 (e.g. an electro-luminescence panel commonly referred to as an EL panel) for illuminating the advertisement display unit C.

Referring to the odor guide unit B, at an upper end (relative to the slant direction) portion of the case 33 including an advertisement window 36, there is formed a cylindrical case portion 33A for housing an unused deodorizing sheet 37 in the form of a rolled sheet strip. Further, at the lower end portion of the case 33, there is formed a further cylindrical case portion 33B for housing a used deodorizing sheet 37 wound into the rolled sheet form.

Inside the upper cylindrical portion 33A, there are provided 'U'-shaped bearings 39 for rotatably and detachably supporting a feed shaft 38 mounting thereon the unused deodorizing sheet roll 37, and a semi-cylindrical case portion **33*a* comprising a part of the cylindrical case portion 33A is pivotable about a hinge portion (d) to be opened to a position for allowing attachment of the deodorizing sheet roll 37. The bearings 39 are formed integrally with caps 40 to be attached to opposed sides of the cylindrical case portion 33A**.

At the bottom inside the upper cylindrical case portion 33A, there is provided a storing portion 42 for detachably storing an aromatic 41 having a triangular shape. At a portion of the case corresponding to the storing portion 42, there are defined a plurality of slits 43.

Inside the lower cylindrical case portion 33B, there are provided 'U'-shaped bearings 45 for rotatably and detachably supporting a winding shaft 44 for winding the used deodorizing sheet roll 37, and a semi-cylindrical case portion **33*b* comprising a part of this cylindrical case portion 33B is pivotable about a hinge portion (e) to be opened to a position for allowing detachment of the used deodorizing sheet roll 37**.

The bearings 45 are formed integrally with caps 46 to be attached to opposed sides of the cylindrical case portion 33B. One cap 46 defines an operational hole 38 for operating, from the outside, the winding shaft 44 for a winding operation by means of a crank-like operational member 47.

The advertisement display unit C continuously forms a partition plate 50 for forming, in the vicinity of and together with a peripheral edge of an advertisement window 36 inside the case 33, a housing space 49 for the advertisement panels 16. Further, inside the panel housing space 49, there are inserted and supported the advertisement panel 16 and a panel-like face illuminating element 51 for illuminating from the under this advertisement panel 16. The face illuminating element 51 is electrically connected with a power circuit 35 and a driver circuit disposed inside the stand box 30.

To the upper end of the partition plate 50, there is attached a spring element 52 for elastically urging the unused deodorizing sheet 37 fed by the feed shaft 38 thereby to prevent unnecessary feeding of the same.

Further, in the bottom face of the case 33, there are formed a plurality of openings 53 for allowing the odorous air rising from the urinal T to come into contact with the deodorizing sheet 37. Then, in this embodiment, the odorous air is guided upwards along the deodorizing sheet 38 while coming into contact with the deodorizing sheet 38 through the openings 53.

Figure 7:
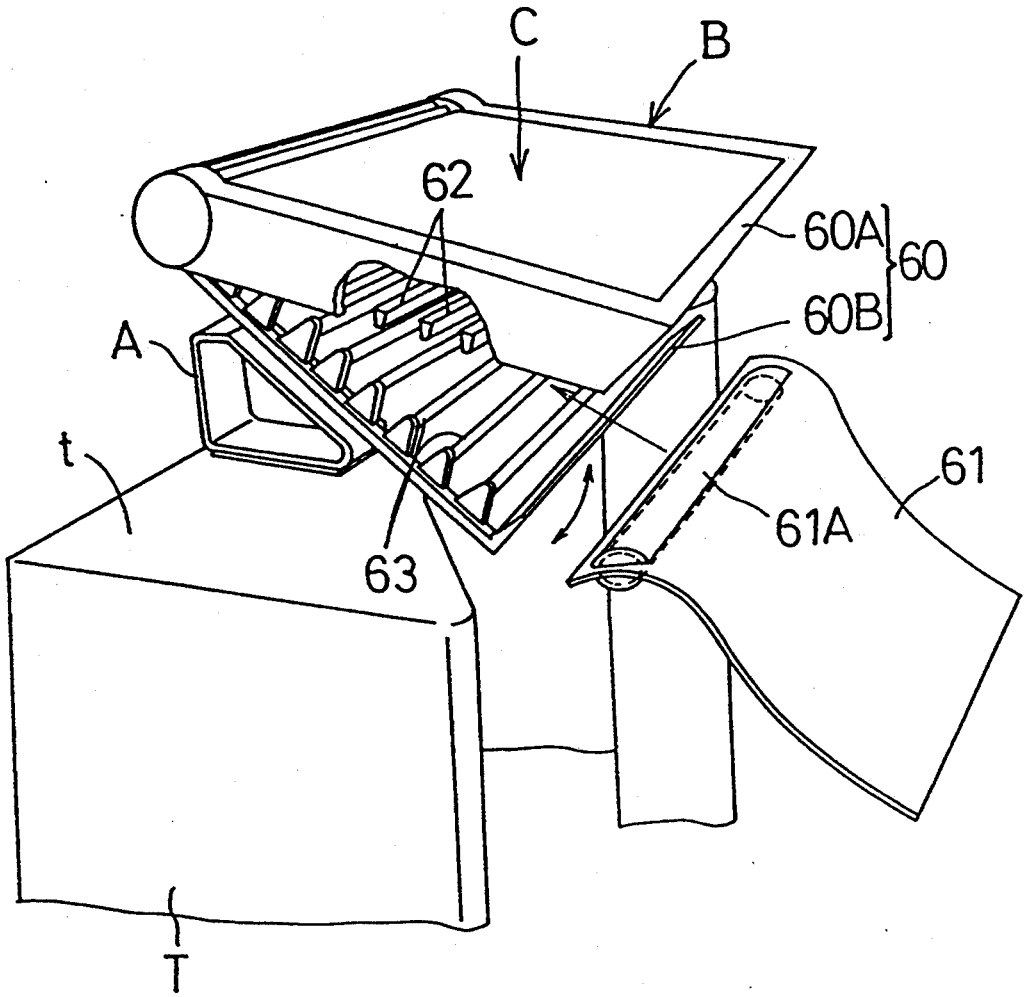
FIG. 7 is a perspective view showing an odor guide apparatus according to a still further embodiment of the invention.

(2) FIG. 7 shows another odor guide apparatus for a toilet. In this case, a case 60 of the odor guide unit B is rendered vertically pivotable about its upper end portion to be opened and closed. A front case portion 60A of this case 60 includes the advertisement display unit C. Opposing faces of the front case portion 60A and of the rear case portion 60B integrally form groups of projections 62, 63 offset in position relative to each other, so as to detachably hold the deodorizing sheet 61 with the sheet 61 being bent in a wave-like pattern.

The deodorizing sheet 61 forms a cylindrical portion 61A for storing an aromatic.

Figure 8:
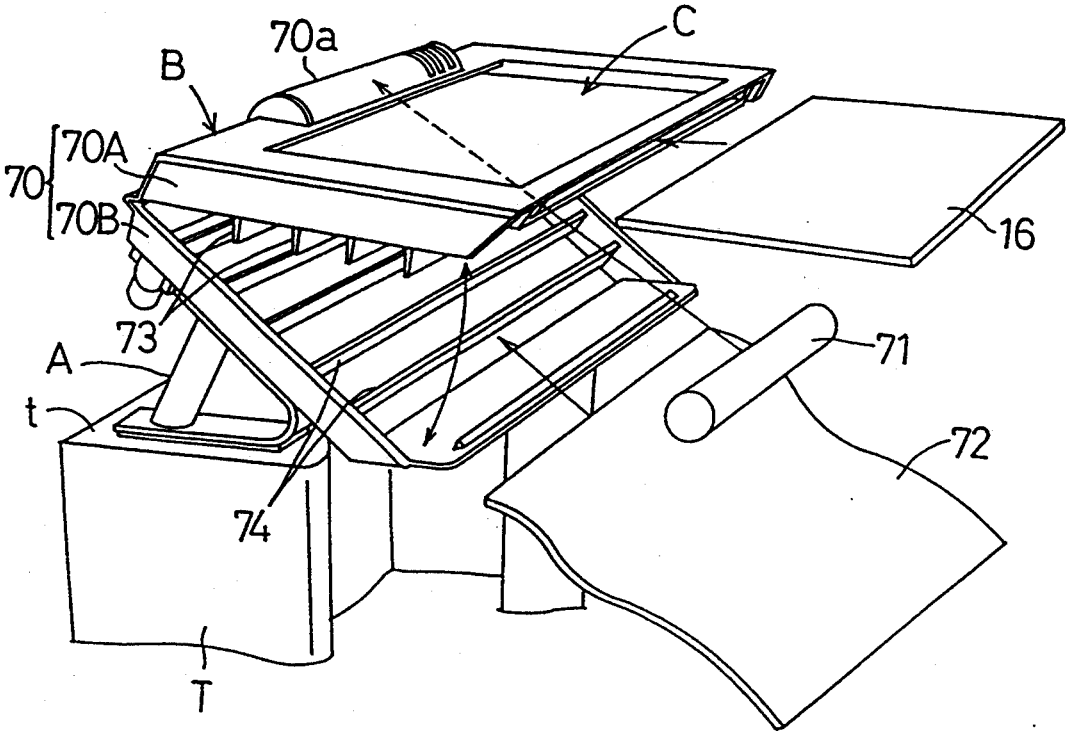
FIG. 8 is a perspective view showing an odor guide apparatus according to a still further embodiment of the invention.

(3) FIG. 8 shows still another odor guide apparatus for a toilet. In this case, like the above-described embodiment, a case 70 of the odor guide unit B is rendered vertically pivotable about its upper end portion to be opened and closed. A front case portion 70A of this case 70 includes the advertisement display unit C and also a semi-cylindrical portion **70*a* for housing an aromatic. Opposing faces of the front case portion 70A and of the rear case portion 70B integrally form groups of projections 73, 74 offset in position relative to each other, so as to detachably hold the deodorizing sheet 72 with the sheet 72** being bent in a wave-like pattern.

Figure 9:
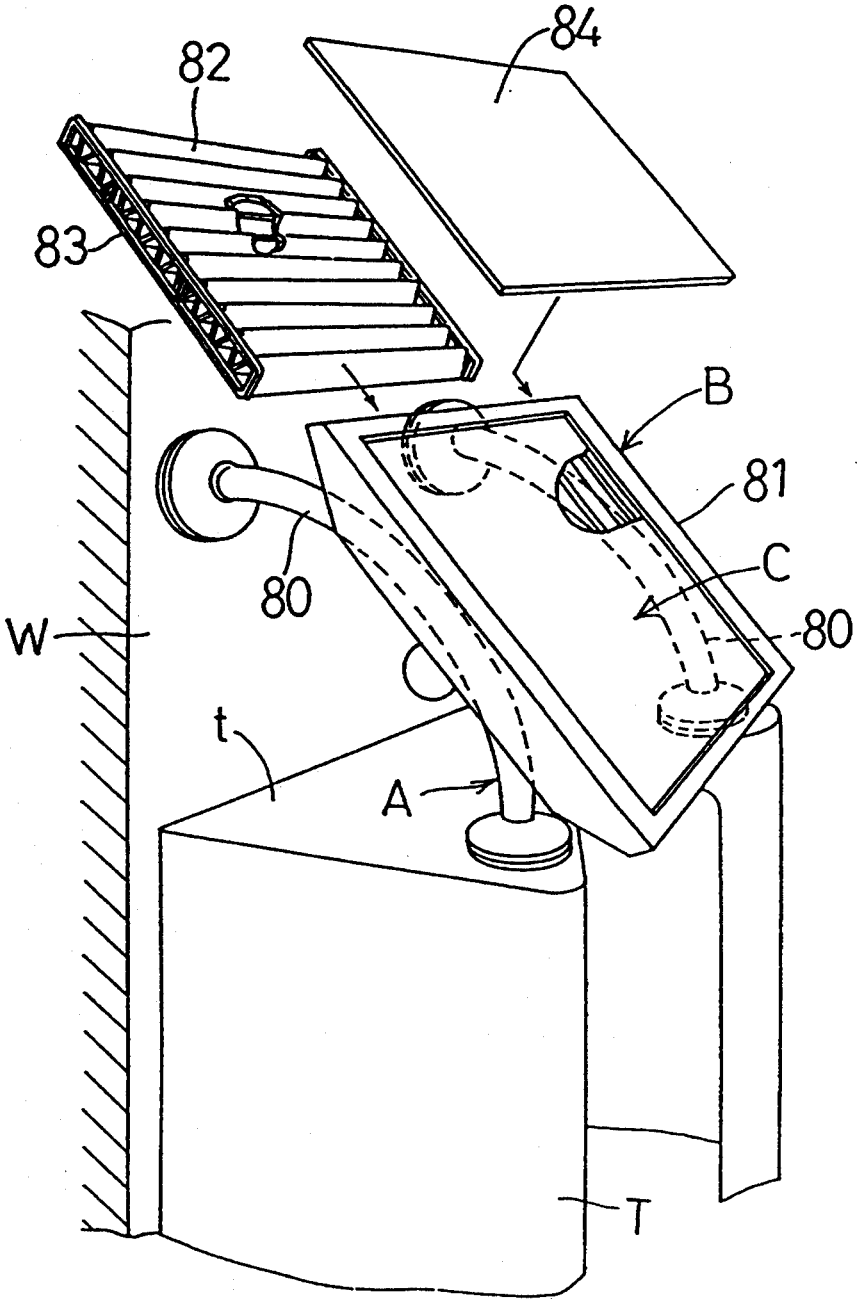
FIG. 9 is a perspective view showing an odor guide apparatus according to a still further embodiment of the invention.

(4) FIG. 9 shows a further odor guide apparatus for a toilet. In this case, the attachment unit A includes a pair of pipes 80 to be fixed between the upper face (t) of the urinal T and a wall face W located in the vicinity of the upper face (t). Then, a case 81 of the odor guide unit B is slidably attached to these pipes 80.

In this embodiment, an odor-eliminating cartridge 83 including an odor-eliminating sheet 82 and an aromatic plate 84 including an aromatic are to be introduced from an upper opening of the case 81.

Figure 10:
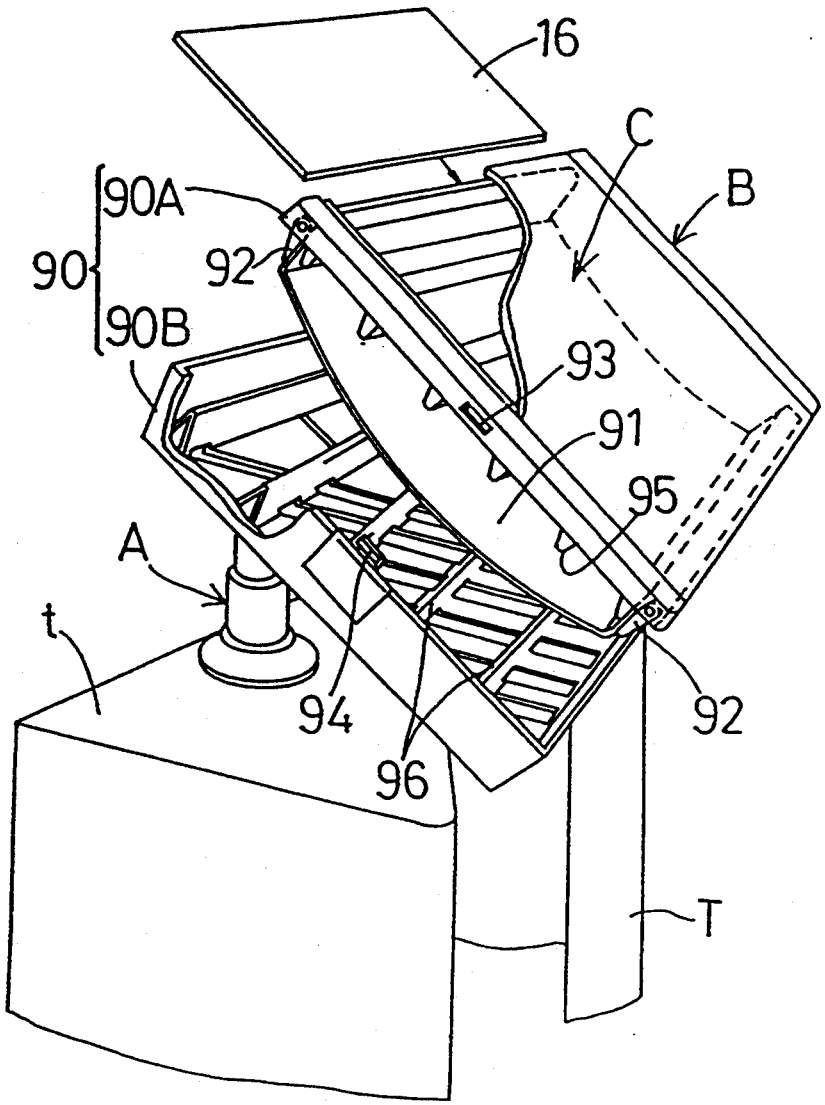
FIG. 10 is a perspective view showing an odor guide apparatus according to a still further embodiment of the invention.

(5) FIG. 10 shows a still further odor guide apparatus for a toilet. In this case, a case 90 of the odor guide unit B includes a front case portion 90A including the advertisement display unit C and a rear case portion 90B to be supported to the attachment unit C, the front case portion 90A and the rear case portion 90B being detachable from each other.

The front case portion 90A includes a binder element 92 for detachably holding an odor-eliminating sheet 91, while the rear case portion 90B includes a stopper pawl 94 engageable with a stopper hold 93 defined in the front case portion 90A. Further, opposing faces of the front case portion 90A and of the rear case portion 90B integrally form groups of projections 95, 96 offset in position relative to each other, so as to detachably hold the odor-eliminating sheet 91 with the sheet 91 being bent in a wave-like pattern.

Figure 11:
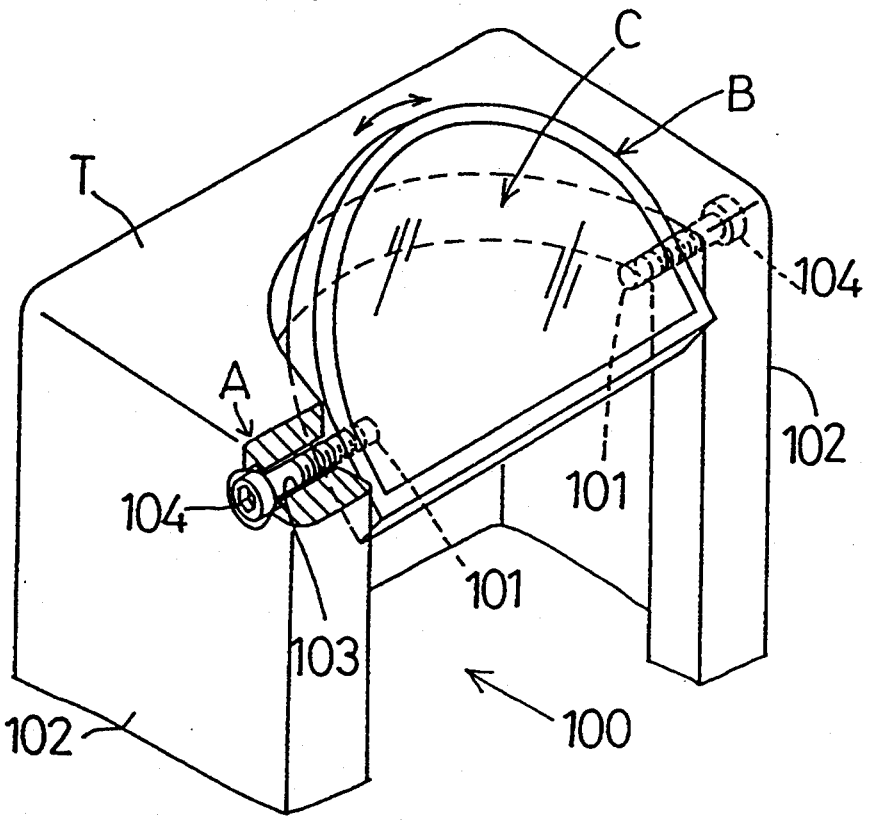
FIG. 11 is a perspective view showing an odor guide apparatus according to a still further embodiment of the invention.

(6) FIG. 11 shows a still further odor guide apparatus for a toilet. In this case, the odor guide unit B is sized to be engageable into an upper portion of a concave portion 100 of the urinal T. And, the attachment unit A includes screw holes 101 defined respectively in the right and left sides of the odor guide unit B, and screws 104 to be threaded into the screw holes 101 from the outside of side walls 102 of the urinal T through through holes 103 defined in the side walls 102.

Further, the odor guide unit B to be fastened to the side walls 102 of the urinal T by the screws 104 is adjustable in its attachment angle through its pivotal displacement about axes of the screws 104.

Figure 12:
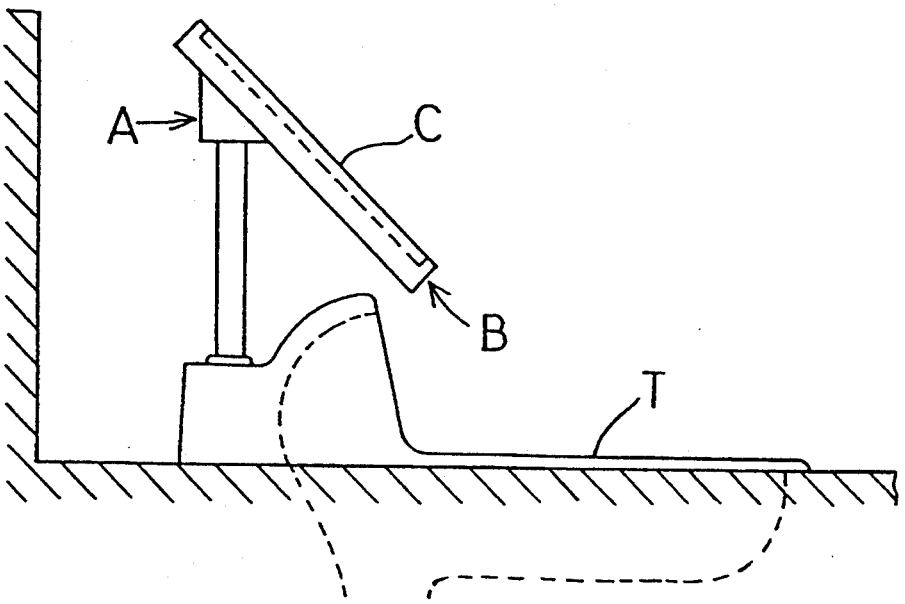
FIG. 12 is a side view showing an odor guide apparatus according to a still further embodiment of the invention.

(7) In the foregoing respective embodiments, the odor guide apparatuses are adapted for use with a urinal. However, the odor guide apparatus of this invention may be used also with a Japanese style toilet bowl T as shown in FIG. 12.

(8) In the foregoing embodiments, the attachment unit A is attached to the upper face (t) of the urinal T or attached between the upper face (t) of the urinal T and the wall face W located in the vicinity of the same. Instead, the attachment unit A may be attached only to the wall face W located in the vicinity of the urinal or toilet bowl.

Incidentally, the attaching portion located in the vicinity of the toile bowl is not limited to the wall face W, but may be a flushing water pipe, a flushing water tank, and so on.

Further, the attaching unit A too may be modified, depending on the shape of the attaching portion.

(9) In the foregoing embodiments, the deodorizing sheet is employed as the deodorizing means. Instead, the invention may be embodied with using a deodorant housed inside a casing, for instance.

(10) The advertisement display unit C may display also a picture, a photograph, a mark and so on, other than the purely commercial advertisement.

(11) In the foregoing embodiments, the advertisement display unit C is provided only to the front face of the odor guide unit B. In case this odor guide unit B has a substantial thickness in the forward-rear direction, the advertisement display units C may be provided to the right and/or left sides of this odor guide unit B.

Further, the advertisement display unit C may be formed like a semi-cylindrical or semi-bowl like shape.

The invention may be embodied in other specific forms without departing from the spirit or essential characteristics hereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An odor guide apparatus for use with a urinal, the apparatus comprising:

an odor guide unit for guiding odor rising from the urinal to flow in a direction away from a user of the urinal;

an attachment unit for fixing the odor guide unit to an attaching portion including the urinal;

wherein said odor guide unit includes:

an advertisement display unit extending from the odor guide unit in a direction facing the user, said advertisement display unit including, at an inner side of said front case member, a partition plate for forming a panel accommodating space for holding two sheets of advertisement panels, with said panels being freely insertable into and withdrawable from said panel accommodating space, and wherein a front plate of said front case member includes an advertisement window for allowing viewing of said advertisement panels;

a pair of case members assembled to each other to form a box-like assembly forming therein a flow passage for guiding odorous air introduced through an inlet opening defined in a back face of said advertisement display unit to an exhaust opening defined at an upper portion of said case members;

a deodorizing sheet detachably attached in said flow passage; and a fan for forcibly guiding the air passing said deodorizing sheet through said exhaust opening to the outside of said odor guide unit, electric means for driving said fan, and a power source for said electric means.

2. An odor guide apparatus as defined in claim 1, wherein said odor guide unit includes means for rendering it angle adjustable with respect to said attaching portion.

3. An odor guide apparatus as defined in claim 2, wherein said attachment unit includes a stand box and said angle-adjustable means includes a flexible support pipe fixed to an upper portion of said stand box, an attachment angle of said odor guide unit with respect to said attachment unit being freely adjustable by flexing said support pipe.

4. An odor guide apparatus as defined in claim 1, wherein said advertisement display unit is attached with a face illuminating element for illuminating the advertisement display unit.

5. An odor guide apparatus as defined in claim 1, wherein said members are vertically pivotable about an upper end of said assembly to be opened and closed, said advertisement display unit being provided to a front case member, said deodorizing sheet being flexibly attached in the form of a wave-like pattern between opposing interior faces of said case members.

6. An odor guide apparatus as defined in claim 5, wherein said deodorizing sheet includes a cylindrical portion for storing an aromatic.

7. An odor guide apparatus as defined in claim 5, wherein said front case member includes a semi-cylindrical portion for storing an aromatic.

8. An odor guide apparatus as defined in claim 1, wherein said attachment unit includes an attachment pipe to be fixed between an upper face of the urinal and a wall face located in the vicinity of the same, said assembly of said odor guide unit being slidably and fixably attached to said pipe.

9. An odor guide apparatus as defined in claim 8, wherein said assembly defines an upper opening for allowing introduction of an odor-eliminating cartridge including said deodorizing sheet and an aromatic plate including an aromatic.

10. An odor guide apparatus as defined in claim 1, wherein said case members are detachable from each other.

11. An odor guide apparatus as defined in claim 10, wherein one of said case members includes a binder element for detachably holding said deodorizing sheet and the other case member includes a stopper pawl engageable with a stopper hole defined in said one case member.

12. An odor guide apparatus as defined in claim 1, wherein said odor guide unit is sized to be engageable into a concave portion of the urinal, said odor guide unit being pivotably attached to a wall of the urinal via said attachment unit so as to be adjustable in its attachment angle relative to the urinal.

13. An odor guide apparatus as defined in claim 1, wherein said deodorizing sheet changes odorous molecules of the odorous air into substantially non-odorous molecules through a chemical reaction process.

* * * * *